United States Patent [19]

Hale et al.

[11] Patent Number: 4,805,782

[45] Date of Patent: Feb. 21, 1989

[54] CAP SHAPING AND DRYING APPARATUS

[76] Inventors: Everett D. Hale; Violet E. Hale, both of 301 Pine Ridge, Manitou Springs, Colo. 80829

[21] Appl. No.: 189,865

[22] Filed: May 3, 1988

[51] Int. Cl.[4] ..... A47G 25/10

[52] U.S. Cl. ..... 211/30; 34/103; 223/66; 223/84; 211/113

[58] Field of Search ..... 211/30, 32, 89, 113; 34/103; 223/66, 84, 85

[56] References Cited

U.S. PATENT DOCUMENTS

| | | | |
|---|---|---|---|
| 1,480,829 | 1/1924 | Moran | 211/32 |
| 1,655,609 | 1/1928 | James | 211/30 |
| 2,177,546 | 10/1939 | Johnson . | |
| 2,182,924 | 12/1939 | Kraft | 223/66 |
| 2,341,643 | 2/1944 | Mincenberg . | |
| 2,471,007 | 5/1949 | Pasznicki | 223/66 X |
| 2,994,436 | 8/1961 | Stull et al. . | |
| 3,108,723 | 10/1963 | Hickey . | |

FOREIGN PATENT DOCUMENTS

| | | | |
|---|---|---|---|
| 764062 | 12/1956 | United Kingdom | 211/89 |

*Primary Examiner*—Robert R. Mackey
*Attorney, Agent, or Firm*—Henderson & Sturm

[57] ABSTRACT

A cap shaping and drying apparatus (10) for caps (100) having a crown (101) and a bill (102); wherein, the apparatus (10) includes: a suspension unit (11); a bill capturing unit (12) operatively associated with the suspension unit (11) and adapted to captively engage the bill (102) of the cap (100), and a support unit (13) connected to the bottom of the suspension unit (11); wherein, the support unit (13) is configured to support the interior of the crown (101) of the cap (100).

1 Claim, 1 Drawing Sheet

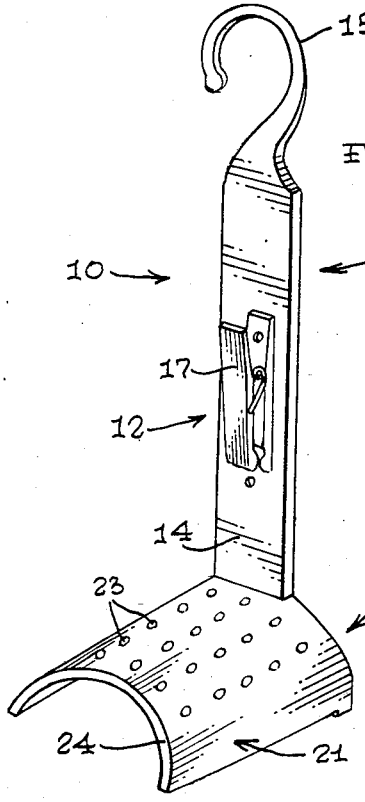
FIG. 1.
FIG. 2.
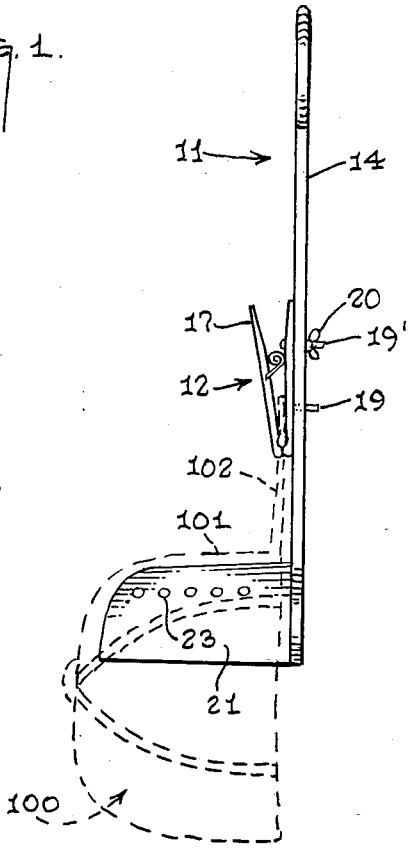
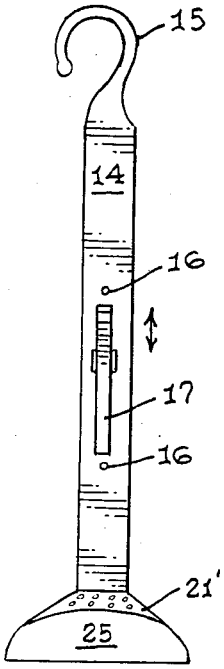
FIG. 3.
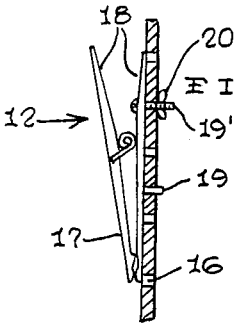
FIG. 7.
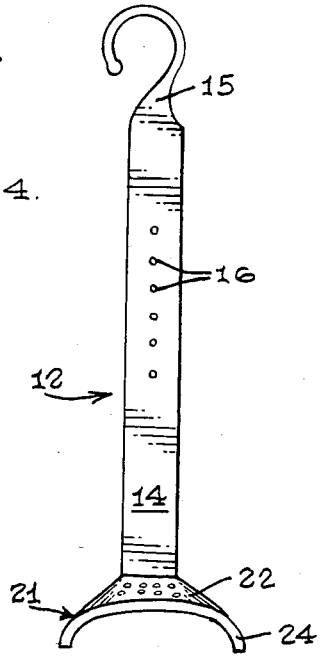
FIG. 4.
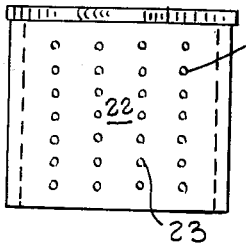
FIG. 5.
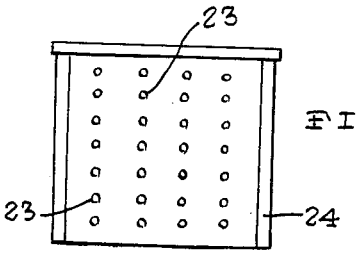
FIG. 6.

CAP SHAPING AND DRYING APPARATUS

TECHNICAL FIELD

The present invention relates generally to support devices for hats and more specifically to a billed cap shaping and drying support apparatus.

BACKGROUND OF THE INVENTION

This invention was the subject matter of Document Disclosure Program Registration No. 184008 filed in the U.S. Patent and Trademark Office on Jan. 7, 1988.

As is to be expected given the former widespread popularity of men's brimmed hats, the prior art is replete with myriad and diverse support devices for this particular style of hat; as can be seen by reference to the following U.S. Pat. Nos.: 2,341,643; 2,177,546; 3,108,723; and, 2,994,436.

While brimmed hats have fallen out of favor in todays society, this type of hat style has been largely replaced by a billed hat which is commonly referred to as a baseball cap.

Following on the heels of the decline of the popularity of the brimmed hat, this country also experienced the vanishing of the hatters trade except for very small scale operations scattered around the country.

As a consequence of the foregoing situation, the vast majority of people who wear a billed cap are left with no other alternative when the cap becomes soiled and dirty, but to subject the cap to either a manual or machine washing. Unfortunately, regardless of the particular mode of washing employed most billed caps do not dry uniformly resulting in both wrinkling and deformation of both the bill and crown of the cap.

Faced with this situation, the owners of billed caps have experienced a longfelt need for an apparatus that would both support and shape a billed cap during the drying process, and these stated objectives were the primary motivating considerations involved in the development of the present invention.

BRIEF SUMMARY OF THE INVENTION

Briefly stated, the cap shaping and drying apparatus that forms the basis of the present invention comprises a suspension unit; a bill capturing; and, a crown support unit.

The suspension unit comprises an elongated suspension member having a hook element disposed on its upper end. In addition, the intermediate portion of the suspension member is provided with a plurality of apertures that will selectively receive the bill capturing unit at a desired vertical height relative to the longitudinal axis of the suspension member.

The bill capturing unit comprises a clamp member adapted to be releasably disposed at various locations along the intermediate portion of the suspension member, and the crown support unit comprises a generally arcuate support member that is disposed on the lower end of the suspension member, and dimensioned to conform to the interior of the crown of a billed cap.

Once a billed cap has been washed, the wet cap is disposed on the cap shaping and drying apparatus as follows: the interior crown of the cap is placed upon the crown support unit such that the bill of the cap is directed towards the mouth of the clamp of the bill capturing unit and the hook element on the suspension unit. At this point if the mouth of the clamp of the bill capturing unit cannot engage the bill of the cap, the bill capturing unit may be moved relative to the suspension unit to effect the bill capturing function.

The final step in the operation of the apparatus involves the suspension of the apparatus from the hook element of the suspension unit, by placing the hook element over a suitable structure such as a shower curtain rod, shower head pipe, clothesline or the like, during the time period required to allow the cap to dry.

Then once the cap has become dry and retained its pre-washed configuration due to the use of the cap shaping and drying apparatus, the cap can be sprayed with starch so that it will retain its desired configuration at least until the next time that it is necessary to wash the cap.

BRIEF DESCRIPTION OF THE DRAWINGS

These and other objects, advantages, and novel features of the invention will soon become apparent from the detailed description of the best mode for carrying out the preferred embodiment of the invention which follows; particularly when considered in conjunction with the accompanying drawings, wherein:

FIG. 1 is a perspective view of the preferred embodiment of the cap shaping and drying apparatus;

FIG. 2 is a side view of the preferred embodiment;

FIG. 3 is a front elevational view of an alternate embodiment of the apparatus;

FIG. 4 is an isolated front view of the suspension unit and the support unit of the preferred embodiment;

FIG. 5 is a top plan view of the structure depicted in FIG. 4;

FIG. 6 is a bottom plan view of the structure depicted in FIG. 4; and,

FIG. 7 is an isolated side plan view of the bill capturing unit.

BEST MODE FOR CARRYING OUT THE INVENTION

As can be seen by reference to the drawings, and in particular to FIG. 1, the cap shaping and drying apparatus that forms the basis of the present invention is designated generally by the reference numeral (10). The cap shaping and drying apparatus (10) comprises in general: a suspension unit (11); a bill capturing unit (12); and a crown support unit (13). These units will now be described in seriatim fashion.

As can be seen by reference to FIGS. 1 and 4, the suspension unit (11) comprises an elongated, thin, flat suspension member (14) having a hook element (15) disposed on its upper end. In addition, the elongated suspension member (14) is further provided with a plurality of equally spaced discrete apertures (16) which are vertically aligned along the intermediate portion of the longitudinal axis of the suspension member (14).

As shown in FIGS. 1, 2, and 7, the bill capture unit (12) comprises a clamp member (17) having a pair of spring loaded jaw elements (18) such as would be found in a conventional clothespin, or the like; wherein the jaw element (18) that is intended to operatively engage the suspension member (14) is provided with a pair of post members (19) whose purpose and function will be explained presently.

As can best be seen by reference to FIG. 7, the post members (19) are dimensioned to be received in spaced apart apertures (16) in the suspension member (14); wherein, at least one of the post members (19') is threaded and provided with a cooperating threaded locking member (20) to secure the bill capturing unit (12) to the intermediate portion of the suspension unit (11). In addition, the remaining post member (19) is provided to prevent the pivotal displacement of the clamp member (17) relative to the suspension member (14) and to maintain the clamp member (17) in alignment with the longitudinal axis of the suspension member (14).

In the preferred embodiment of the cap shaping and drying apparatus illustrated in FIGS. 1, 2, and 4 thru 6, the crown support unit (13) comprises a support member (21) that projects outwardly from the bottom portion of the elongated suspension member (14); wherein, the top surface (22) of the support member (21) is provided with an elongated arcuate configuration that will conform to the interior curvature of the crown (101) of a billed cap (100), and wherein the support member (21) is further provided with a plurality of holes (23) that will promote the circulation of air to speed up the drying process of the wet cap (100).

In the embodiment depicted in FIGS. 1, 2 and 4 thru 6, the major components of the apparatus (10) are fabricated from plastic and the support member (21) comprises a contoured sheet (24) of plastic to reduce the overall weight of the apparatus. However, in the alternate embodiment of the apparatus (10) depicted in FIG. 3, the major components of the apparatus (10) is fabricated from wood; wherein, the support member (21') is formed from a carved block (25) of wood.

To operate the apparatus (10), the user would place the crown (101) of the wet cap (100) on the curved support member (21) and then adjust the location of the clamp member (17) relative to the suspension member (14) such that the jaws (18) of the clamp member (17) will captively engage the bill (102) of the cap (100) to retain the cap (100) on the apparatus (10) while the cap (100) is drying. At this point, the hook element (15) of the suspension member (14) may be engaged with an elevated structure (not shown) such as a clothesline, shower curtain rod, shower head pipe, etc. during the drying process.

Having thereby described the subject matter of this invention, it should be obvious that many substitutions, modifications, and variations of the apparatus (10) are possible in light of the above teachings. It is therefore to be understood that the invention as taught and described herein is only to be limited to the extent of the breadth and scope of the appended claims.

We claim:

1. A cap shaping and drying apparatus for caps having a crown and a bill wherein the cap shaping and drying apparatus consists of:

a suspension unit comprising an elongated suspension member having a top portion, an intermediate portion and a bottom portion; wherein, the top portion of the suspension member is provided with a hook element; wherein, the intermediate portion of the suspension member is provided with a plurality of spaced and vertically aligned apertures;

a capture unit comprising a clamp member having a pair of spring loaded jaw elements which are operatively associated with the intermediate portion of the suspension member; wherein, the clamp member is adapted to captively secure the bill of said cap; and, a support unit comprising a support member secured to the bottom portion of the suspension member; wherein, the top surface of the support member is provided with an arcuate configuration that will conform to the interior of the crown of said cap; and, wherein the support member is further provided with a plurality of holes to promote air circulation to the crown of said cap; wherein, the clamp member is further provided with a pair of spaced post members that are dimensioned to be received in selected ones of said plurality of spaced apertures in said suspension member; and, at least one of the pair of post members is threaded and provided with a cooperating locking member for operatively connecting the clamp member to said suspension member.

* * * * *